US010533427B2

(12) United States Patent
Marsh et al.

(10) Patent No.: US 10,533,427 B2
(45) Date of Patent: Jan. 14, 2020

(54) TURBINE AIRFOIL HAVING FLOW DISPLACEMENT FEATURE WITH PARTIALLY SEALED RADIAL PASSAGES

(71) Applicant: Siemens Aktiengesellschaft, München (DE)

(72) Inventors: Jan H. Marsh, Orlando, FL (US); Paul A. Sanders, Cullowhee, NC (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 158 days.

(21) Appl. No.: 15/752,262

(22) PCT Filed: Aug. 28, 2015

(86) PCT No.: PCT/US2015/047335
§ 371 (c)(1),
(2) Date: Feb. 13, 2018

(87) PCT Pub. No.: WO2017/039572
PCT Pub. Date: Mar. 9, 2017

(65) Prior Publication Data

US 2019/0024515 A1 Jan. 24, 2019

(51) Int. Cl.
*F01D 5/08* (2006.01)
*F01D 5/18* (2006.01)
*F01D 5/14* (2006.01)

(52) U.S. Cl.
CPC ..... *F01D 5/188* (2013.01); *F01D 5/147* (2013.01); *F01D 5/18* (2013.01); *F05D 2220/32* (2013.01);
(Continued)

(58) Field of Classification Search
CPC ..... F01D 5/189; F05D 2260/201; F05D 2260/202; F05D 2260/204; F05D 2260/22141
See application file for complete search history.

(56) References Cited

U.S. PATENT DOCUMENTS 3,902,820 A 9/1975 Amos
4,063,851 A 12/1977 Weldon
(Continued)

FOREIGN PATENT DOCUMENTS

EP 2716868 A2 4/2014
FR 2195256 A5 3/1974
(Continued)

OTHER PUBLICATIONS

PCT International Search Report and Written Opinion dated May 3, 2016 corresponding to PCT Application PCT/US2015/047335 filed Aug. 28, 2015.

*Primary Examiner* — Ninh H. Nguyen

(57) ABSTRACT

A turbine airfoil (10) includes a flow displacement element (26A-B, 26A'-B') positioned in an interior portion (11) of an airfoil body (12) between a pair of adjacent partition walls (24) and comprising a radially extending elongated main body (28). The main body (28) is spaced from the pressure and suction side walls (16, 18) and further spaced from one or both of the adjacent partition walls (24), whereby a first near wall passage (72) is defined between the main body (28) and the pressure side wall (16), a second near wall passage (74) is defined between the main body (28) and the pressure side wall (18) and a central channel (76) is defined between the main body (28) and a respective one of the adjacent partition walls (24). The central channel (76) is connected to the near wall passages (72, 74) along a radial extent. One or more radial ribs (64) are positioned in the
(Continued)

central channel (76) that extend partially across the central channel (76) between the main body (28) and the respective adjacent partition wall (24).

14 Claims, 5 Drawing Sheets

(52) U.S. Cl.
CPC ..... *F05D 2240/12* (2013.01); *F05D 2240/30* (2013.01); *F05D 2260/201* (2013.01); *F05D 2260/202* (2013.01); *F05D 2260/22141* (2013.01)

(56) References Cited

U.S. PATENT DOCUMENTS

| | | | | |
|---|---|---|---|---|
| 5,516,260 | A | 5/1996 | Damlis et al. | |
| 6,120,244 | A * | 9/2000 | Fukura | F01D 5/189 29/889.72 |
| 7,918,647 | B1 | 4/2011 | Liang | |
| 8,366,391 | B2 * | 2/2013 | Tsukagoshi | F01D 5/16 416/233 |
| 2010/0054915 | A1 | 3/2010 | Devore et al. | |
| 2015/0184538 | A1 | 7/2015 | Smith | |
| 2017/0030218 | A1 * | 2/2017 | Papple | F01D 5/189 |
| 2018/0347466 | A1 * | 12/2018 | Correia | F01D 5/189 |

FOREIGN PATENT DOCUMENTS

| | | | |
|---|---|---|---|
| JP | S62271902 | A | 11/1987 |
| JP | H112103 | A | 1/1999 |

* cited by examiner

VIEW III-III

VIEW IV-IV

VIEW V-V

TURBINE AIRFOIL HAVING FLOW DISPLACEMENT FEATURE WITH PARTIALLY SEALED RADIAL PASSAGES

BACKGROUND

1. Field

The present invention is directed generally to turbine airfoils, and more particularly to turbine airfoils having internal cooling channels for conducting a cooling fluid through the airfoil.

2. Description of the Related Art

In a turbomachine, such as a gas turbine engine, air is pressurized in a compressor section and then mixed with fuel and burned in a combustor section to generate hot combustion gases. The hot combustion gases are expanded within a turbine section of the engine where energy is extracted to power the compressor section and to produce useful work, such as turning a generator to produce electricity. The hot combustion gases travel through a series of turbine stages within the turbine section. A turbine stage may include a row of stationary airfoils, i.e., vanes, followed by a row of rotating airfoils, i.e., turbine blades, where the turbine blades extract energy from the hot combustion gases for providing output power. Since the airfoils, i.e., vanes and turbine blades, are directly exposed to the hot combustion gases, they are typically provided with internal cooling channels that conduct a cooling fluid, such as compressor bleed air, through the airfoil.

One type of airfoil extends from a radially inner platform at a root end to a radially outer portion of the airfoil, and includes opposite pressure and suction sidewalls extending span-wise along a radial direction and extending axially from a leading edge to a trailing edge of the airfoil. The cooling channels extend inside the airfoil between the pressure and suction sidewalls and may conduct the cooling fluid in a radial direction through the airfoil. The cooling channels remove heat from the pressure sidewall and the suction sidewall and thereby avoid overheating of these parts.

SUMMARY

Briefly, aspects of the present invention provide an internally cooled turbine airfoil having a flow displacement feature with a partially sealed radial passage.

Embodiments of the present invention provide a turbine airfoil that comprises a generally hollow airfoil body formed by an outer wall extending span-wise along a radial direction. The outer wall comprises a pressure side wall and a suction side wall joined at a leading edge and a trailing edge. A chordal axis is defined extending generally centrally between the pressure side wall and the suction side wall.

According to a first aspect of the invention, a turbine airfoil includes plurality of radially extending partition walls positioned in an interior portion of the airfoil body connecting the pressure and suction side walls. The partition walls are spaced along the chordal axis. A flow displacement element is positioned in a space between a pair of adjacent partition walls. The flow displacement element comprises a radially extending elongated main body which is spaced from the pressure and suction side walls and further spaced from one or both of the adjacent partition walls, whereby a first near wall passage is defined between the main body and the pressure side wall, a second near wall passage is defined between the main body and the suction side wall and a central channel is defined between the main body and a respective one of the adjacent partition walls. The central channel is connected to the first and second near wall passages along a radial extent. One or more radial ribs are positioned in the central channel that extend partially across the central channel between the main body and the respective adjacent partition wall.

According to a second aspect of the invention, a turbine airfoil includes a plurality of radially extending coolant passages formed in an interior portion of the airfoil body. At least one coolant passage is formed of a first near wall passage adjacent to the pressure side wall, a second near wall passage adjacent to the suction side wall, and a central channel extending transverse to the chordal axis and being connected to the first and second near wall passages along a radial extent. A width of the central channel along the chordal axis is partially sealed along said radial extent.

BRIEF DESCRIPTION OF THE DRAWINGS

The invention is shown in more detail by help of figures. The figures show preferred configurations and do not limit the scope of the invention.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Figure 1:
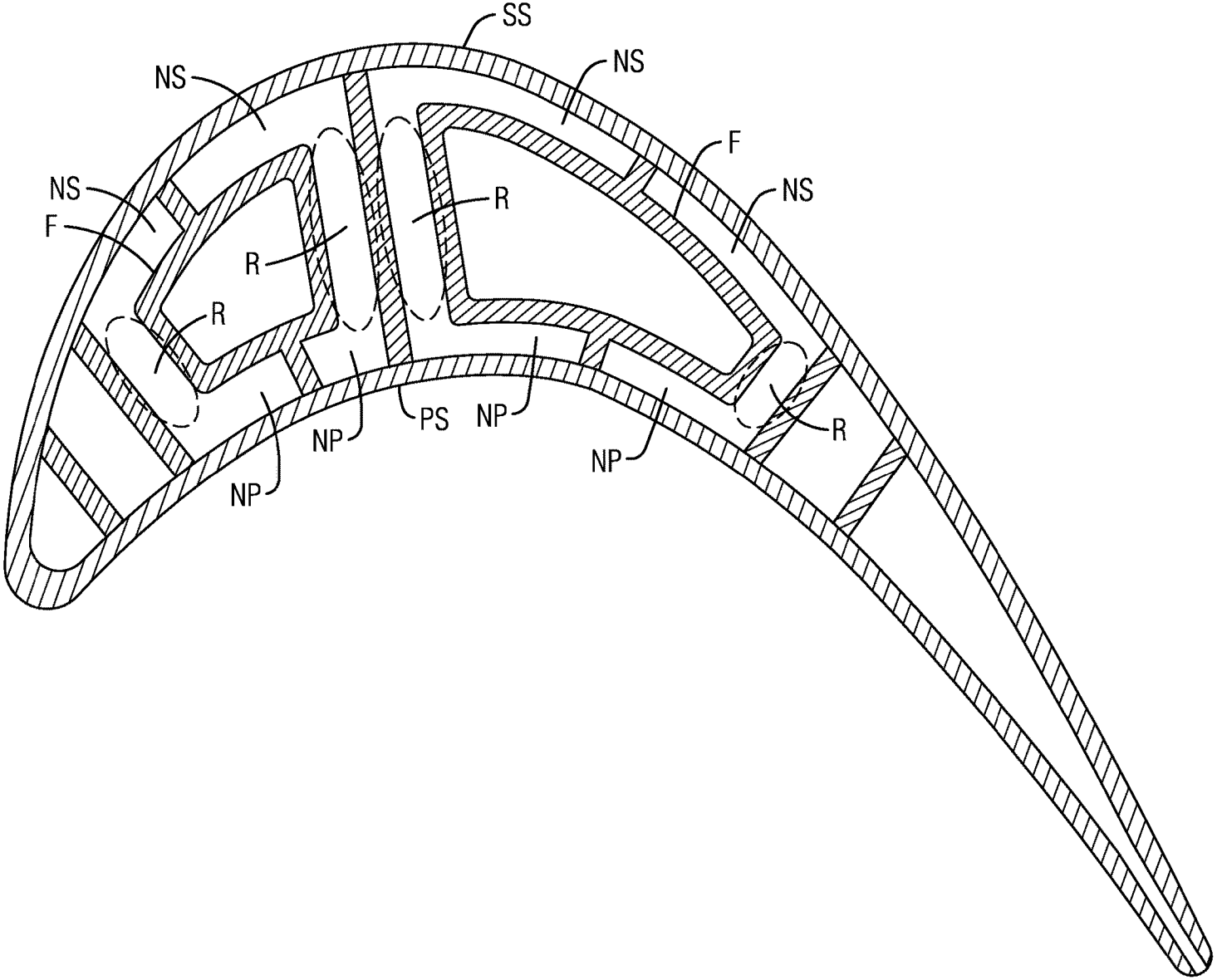
FIG. 1 is a cross-sectional view through a turbine airfoil with near wall cooling passages.

Aspects of the present invention relate to an internally cooled turbine airfoil. In a gas turbine engine, coolant supplied to the internal cooling passages in a turbine airfoil often comprises air diverted from a compressor section. In many turbine airfoils, the cooling passages extend inside the airfoil between the pressure and suction side walls and may conduct the coolant air in alternating radial directions through the airfoil, to form a serpentine cooling path. Achieving a high cooling efficiency based on the rate of heat transfer is a significant design consideration in order to minimize the volume of coolant air diverted from the compressor for cooling. As available coolant air is reduced, it may become significantly harder to cool the airfoil. For example, in addition to being able to carry less heat out of the airfoil, lower coolant flows may also make it difficult to generate high enough internal Mach numbers to meet the cooling requirements. As shown in FIG. 1, one way of addressing this problem is to reduce the flow cross-section of the radial cooling passages by providing one or more flow displacement elements F that displace the coolant flow from the centre of the airfoil toward the hot pressure and suction side walls PS and SS, forming respective near wall cooling passages NP and NS adjacent to the hot pressure and suction side walls PS and SS. For avoiding high thermal stresses, the near wall cooling passages NP and NS may be connected along the radial extent by respective connecting passages R. The present inventors have noted that especially for a turbine blade under rotation, the coolant flow may migrate from the suction side SS to the pressure side PS via the connecting passages R, producing an uneven distribution of flow. Moreover, in any turbine airfoil including rotating blades and stationary vanes, the coolant flowing radially through the connecting passages R may be largely wasted on walls that are not exposed to hot gases and do not require substantial cooling, which may not be preferred, especially in a low coolant flow design. Embodiments of the present invention provide an airfoil design that may alleviate one or more of the above noted conditions while also avoiding high thermal stresses.

Figure 2:
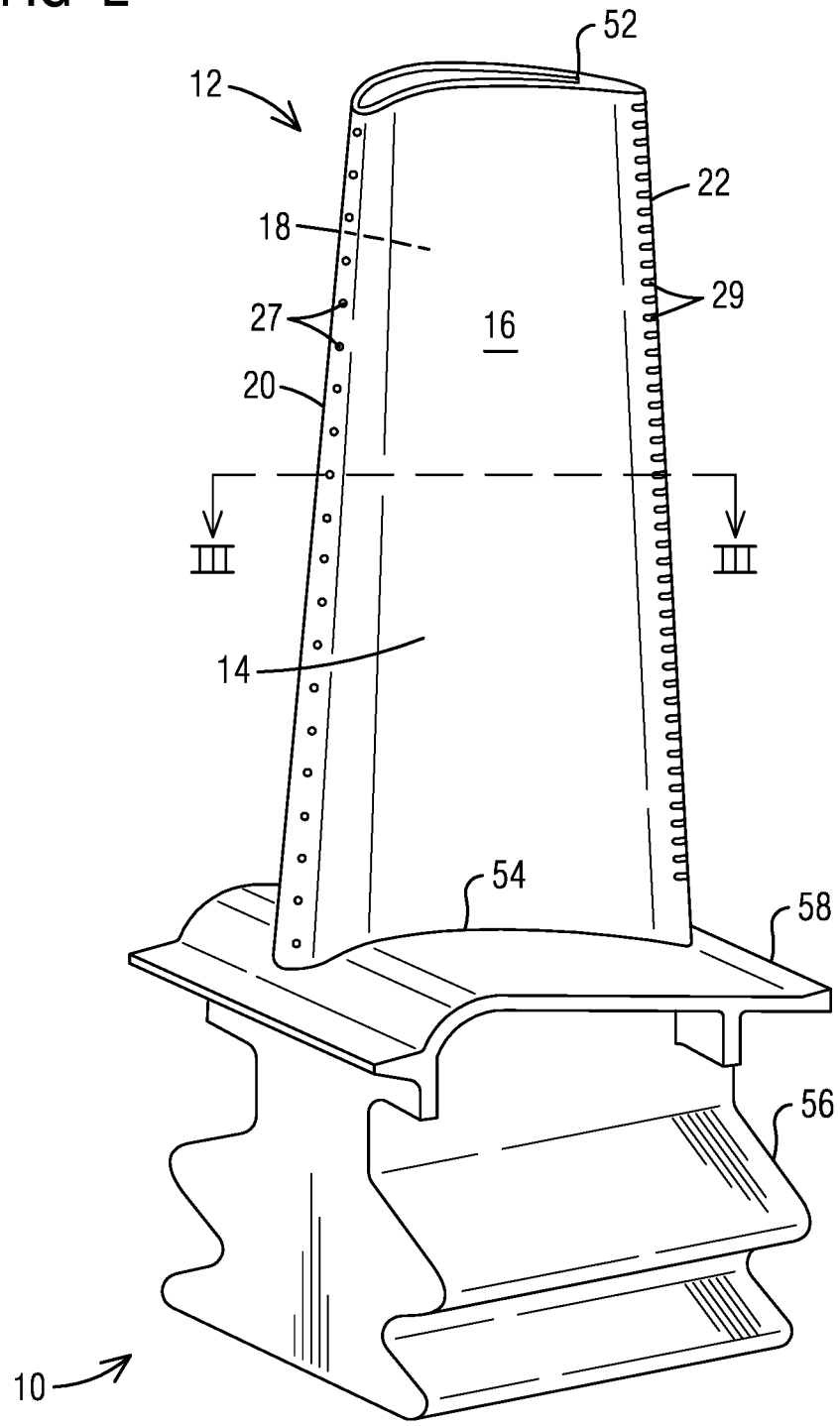
FIG. 2 is a perspective view of an example of a turbine airfoil according to one embodiment.

Referring now to FIG. 2, a turbine airfoil 10 is illustrated according to one embodiment. As illustrated, the airfoil 10 is a turbine blade for a gas turbine engine. It should however be noted that aspects of the invention could additionally be incorporated into stationary vanes in a gas turbine engine. The turbine airfoil 10 may include a generally elongated hollow airfoil body 12 formed from an outer wall 14 adapted for use, for example, in a high pressure stage of an axial flow gas turbine engine. The outer wall 14 extends span-wise along a radial direction of the turbine engine and includes a generally concave shaped pressure side wall 16 and a generally convex shaped suction side wall 18. The pressure side wall 16 and the suction side wall 18 are joined at a leading edge 20 and at a trailing edge 22. As illustrated, the generally elongated hollow airfoil body 12 may be coupled to a root 56 at a platform 58. The root 56 may couple the turbine airfoil 10 to a disc (not shown) of the turbine engine. The generally hollow airfoil body 12 is delimited in the radial direction by a radially outer end face or airfoil tip 52 and a radially inner end face 54 coupled to the platform 58. In other embodiments, the turbine airfoil 10 may be a stationary turbine vane with a radially inner end face coupled to the inner diameter of the turbine section of the turbine engine and a radially outer end face coupled to the outer diameter of the turbine section of the turbine engine. A thermal barrier coating (TBC) may be provided on the external surfaces of the turbine airfoil 10 exposed to hot gases, as known to one skilled in the art.

Figure 3:
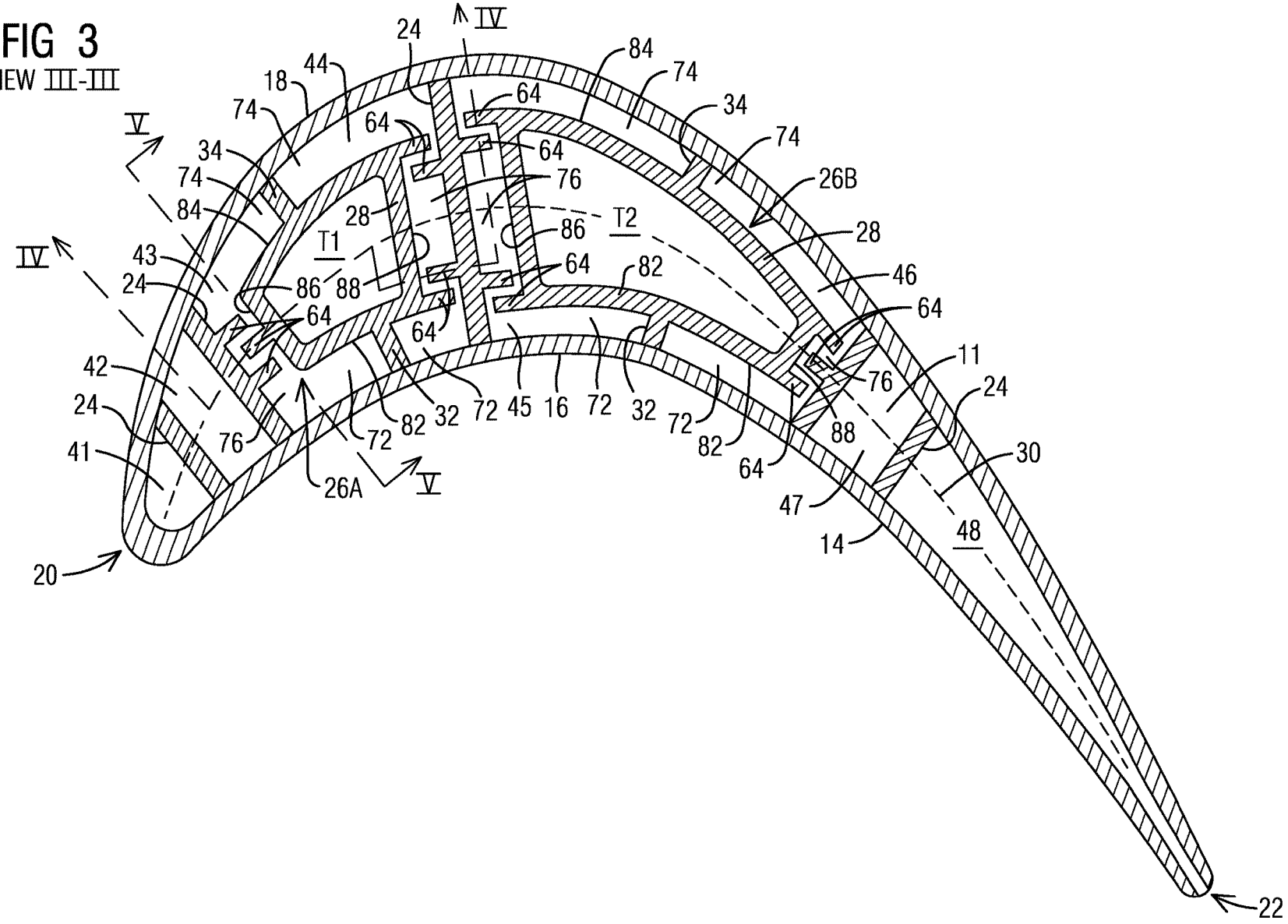
FIG. 3 is a cross-sectional view through the turbine airfoil along the section III-III of FIG. 2 according to a first embodiment.

Referring to FIG. 3, a chordal axis 30 is defined extending generally centrally between the pressure side wall 16 and the suction side wall 18. As illustrated, the generally hollow elongated airfoil body 12 comprises an interior portion 11, within which a plurality of partition walls 24 are positioned spaced apart chordally, i.e., along the chordal axis 30. The partition walls 24 extend radially, and may further extend linearly across the chordal axis 30 connecting the pressure side wall 16 and the suction side wall 18 to define radial cavities 41-48 that form internal cooling passages. A cooling fluid, such as air from a compressor section (not shown), flows through the internal cooling passages 41-48 and exits the airfoil body 12 via exhaust orifices 27 and 29 positioned along the leading edge 20 and the trailing edge 22 respectively (see FIG. 2). The exhaust orifices 27 provide film cooling along the leading edge 20. Although not shown in the drawings, film cooling orifices may be provided at multiple locations, including anywhere on the pressure side wall 16, suction side wall 18, leading edge 20 and the airfoil tip 52. However, embodiments of the present invention provide enhanced heat transfer coefficients using low coolant flow, which make it possible to limit film cooling only to the leading edge 20, as shown in FIG. 2.

According to the illustrated embodiment, one or more flow displacement elements 26A, 26B are provided, each being positioned in a space between a pair of adjacent partition walls 24. Each flow displacement element 26A, 26B comprises a main body 28 spaced from the pressure and suction side walls 16, 18 and further spaced from the adjacent partition walls 24. In the illustrated embodiment, the main body 28 is hollow and elongated along a radial direction (see FIG. 4) to define a respective elongated radial cavity T1, T2 therewithin. In the illustrated embodiment, each of the cavities T1, T2 is an inactive cavity that does not conduct a cooling fluid, but serves to take up a portion of the flow cross-section at the center of the airfoil, displacing coolant flow toward first and second near wall passages 72, 74. In the present example, the inactive cavities T1, T2 each extend radially from a first end to a second end. The first end (not shown) may be located, for example at the root 56 and may be closed, while the second end may be located in the interior portion 11 of the airfoil body 12, terminating short of the airfoil tip 52 to define a gap 50 (see FIG. 4). In shown example, the second end is closed by a tip cap 39. In another embodiment, for example in case of a stationary turbine vane, in contrast to having inactive cavities, one or more of the hollow elongated main bodies 28 may define secondary cooling passages, which are isolated from fluid communication with the adjacent radial cavities 43-46. The secondary cooling passages may, for example, carry a cooling fluid between the inner and outer diameters of the turbine section of the turbine engine. In still other embodiments, one or more of the flow displacement elements 26A, 26B may have main bodies 28 having a solid body construction without any cavities. A hollow construction of the main body 28 may provide reduced thermal stresses as compared to a solid body construction.

The first near wall passage 72 extends radially and is defined between the main body 28 and the pressure side wall 16. The second near wall passage 74 extends radially and is defined between the main body 28 and the suction side wall 18. The first and second near wall passages 72, 74 are connected along a radial extent by a respective central channel 76 extending radially and being defined between the main body 28 and a respective one of the adjacent partition walls 24. In radial flow cross-section, the first and second near wall passages 72, 74 extend generally lengthwise along the pressure side wall 16 and along the suction side wall 18 respectively, and extend widthwise between the main body 28 and the pressure or suction side wall 16, 18 respectively. In the illustrated example, the lengthwise direction of the near wall passages 72, 74 may extend generally parallel to the chordal axis 30, while the widthwise direction of the near wall passages 72, 74 may extend generally perpendicular to the chordal axis 30. In radial flow cross-section, the central channel 76 has a lengthwise direction extending from the first near wall passage 72 to the second near wall passage 74, and a widthwise direction extending from the main body 28 to the respective adjacent partition wall 24. In the illustrated example, the lengthwise direction of the central channel 76 is transverse to the chordal axis 30, while the widthwise direction of the central channel 76 is generally parallel to the chordal axis 30. To achieve a low coolant flow while providing an effective near wall cooling of the hot outer wall 14, one or more of the first near wall passages 72, the second near wall passages 74 and the central channels 76 may be elongated, having a lengthwise dimension that is greater than a widthwise dimension.

In contrast to FIG. 1, in the embodiment shown in FIG. 3, one or more radial ribs 64 may be positioned in the central channel 76 that extend partially across the width of the central channel 76 between the main body 28 and the respective adjacent partition wall 24. One or more of the radial ribs 64 may be connected to the main body 28 along a radial extent and spaced from the respective adjacent partition wall 24. Alternately or additionally, one or more of the radial ribs 64 may be connected to the respective adjacent partition wall 24 along a radial extent and spaced from the main body 28. In the embodiment illustrated in FIG. 3, a plurality of radial ribs 64 are positioned in each central channel 76, spaced in the lengthwise direction of the respective central channel 76, which in this case is transverse to the chordal axis 30. The radial ribs 64 extend in the widthwise direction of the central channel 76, which in this case is generally parallel to the chordal axis 30 and may further extend radially, for example, substantially along the entire radial extent of the central channel 76 (see FIG. 4). In the shown embodiment, consecutive radial ribs 64 are alternatingly connected either to the main body 28 or to the respective adjacent partition wall 24, but not to both. The consecutive radial ribs 64 are arranged in a staggered manner along the length of the central channel 76 and overlap partially in the widthwise direction of the central channel 76. In this case, the overlap may be in a direction generally parallel to the chordal axis 30. A ship lap sealing configuration may thereby be realized. In this configuration, the central channels 76 are not blocked off completely, due to the partial extension of each of the radial ribs 64 across the width of the respective central channel 76. That is, the cooling fluid is allowed to pass radially through the central channels 76, as well as the near wall passages 72, 74. However, this configuration reduces the likelihood of migration of the cooling fluid to and from the first and second near wall passages 72, 74 via the central channel 76, which may otherwise take place, for example, in a turbine blade under rotation. This improves robustness of the design to ensure that the cooling fluid stays where it is intended.

Figure 4:
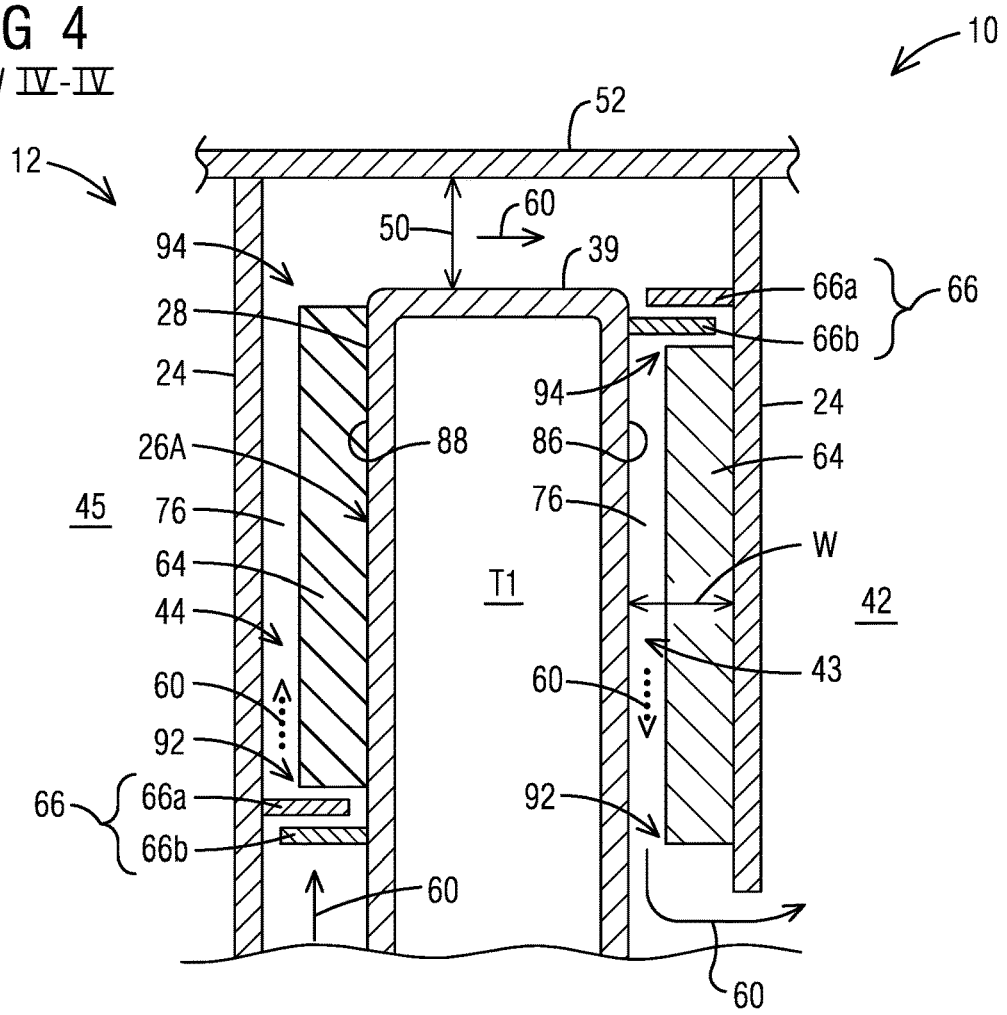
FIGS. 4 and 5 are cross-sectional views along section lines IV-IV and V-V in FIG. 3 respectively.
Figure 5:
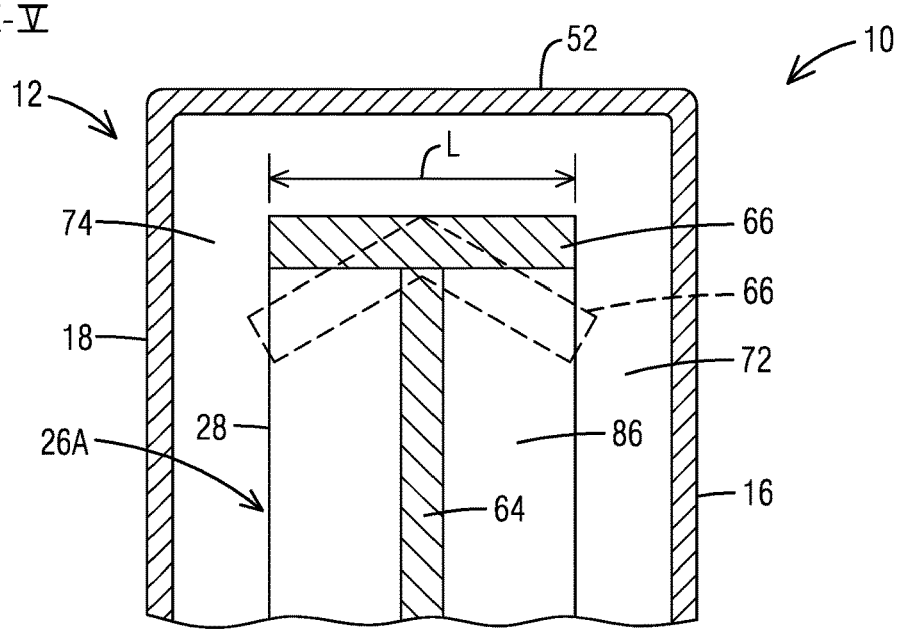

Each of the radial ribs 64 may extend from a first end 92 to a second 94, which may be respectively aligned with the radially inner and outer ends of the respective central channel 76. As a further feature, as shown in FIG. 4, a flow blocking element 66 may be positioned to cover the central channel 76 at one or both of the ends 92, 94 of the radial ribs 64, especially at the upstream end of the respective central channel 76 with respect to the coolant flow 60 as shown in FIG. 4. The flow blocking element 66 may extend substantially or entirely across the flow cross-section of the central channel 76 at the respective radial end 92, 94 of the one or more radial ribs 64. The flow blocking element 66 may be made, for example, of a flow blocking rib extending fully or partially across the width of the central channel 76 at the radial end 92, 94 and further extending in the lengthwise direction of the central channel 76. In accordance with an embodiment of the invention, to avoid thermal stresses due to differential thermal expansion, instead of having a single rib connected to both the main body 28 and the adjacent partition wall 24, the flow blocking 66 element may comprise multiple overlapping ribs that in combination extend across the entire width of the central channel 76 at the radial end 92, 94. In the exemplary embodiment shown in FIG. 4, each flow blocking element 66 constitutes a pair of overlapping ribs 66*a*, 66*b* arranged staggered in the radial direction that individually extend partially across the width W of the central channel 76. The rib 66*a* is connected to the main body 28 and spaced from the respective adjacent partition wall 24, running a tight gap, while the rib 66*b* is connected to the respective adjacent partition wall 24 and spaced from the main body 28, running a tight gap. In combination, the overlapping ribs 66*a*, Ebb may extend across the entire width W of the central channel to cover the central channel 76 at the end 92 or 94. In other embodiments, it may be possible to use only one of the ribs 66*a* or 66*b* as the flow blocking element 66, which is connected either to the main body 28 or the respective adjacent partition wall 24 and runs a tight gap with the other. Further, as shown in FIG. 5, the flow blocking element 66 (or ribs 66*a-b*) may extend in the lengthwise direction of the central channel 76 across all or part of the length L of the central channel 76, which in this case is transverse to the chordal axis 30. It may also be possible to configure the flow blocking element 66 to be made up of multiple parts that overlap along the length direction of the central channel 76, and which in combination may cover the entire length L of the central channel 76. As illustrated in FIG. 4, on account of the flow blocking element 66, the cooling fluid 60 may be prevented from entering the respective central channel 76 from the radially inner or outer ends, thereby effectively displacing the almost the entirety of cooling fluid toward the first and second near wall passages 72, 74, as schematically illustrated by dotted arrows 60. Once the cooling fluid is in the first and second near wall passages 72, 74, the radial ribs 64 would prevent migration of the cooling fluid to and from the first and second near wall passages 72, 74. The ability to displace the cooling fluid entirely or at least significantly toward the areas of interest, i.e., the pressure and suction side walls 16, 18, and avoid areas where cooling is not of high necessity, allows for a further reduction of coolant flow. Referring to FIG. 5, as a further variant, the flow blocking element 66 may be contoured, as shown by dashed lines, in a direction along the length of the central channel 76, to specifically guide the cooling fluid away from the central channel 76 and toward the near wall passages 72, 74.

Referring back to FIG. 3, the main body 28 of each of the flow displacement elements 26A, 26B may extend across the chordal axis 30 such that the first and second near wall passages 72, 74 are positioned on opposite sides of the chordal axis 30. In the illustrated embodiment, the main body 28 includes first and second opposite side walls 82, 84 that respectively face the pressure and suction side walls 16, 18. The first and second side walls 82, 84 may be spaced in a direction generally perpendicular to the chordal axis 30. In the shown embodiment, the first side wall 82 is generally parallel to the pressure side wall 16 and the second side wall 84 is generally parallel to the suction side wall 18. The main body 28 further comprises forward and aft end walls 86, 88 that may extend between the first and second side walls 82, 84 and may be spaced along the chordal axis 30. As shown, the connector ribs 32, 34 may be respectively coupled to the first and second side walls 82, 84. The radial ribs 64 each extend partially across the central channel 76 between the forward or aft end wall 86, 88 of the main body 28 and the respective adjacent partition wall 24. In alternate embodiments, the main body 28 may have, for example, a triangular, circular, elliptical, oval, polygonal, or any other shape or outer contour.

In the illustrated embodiment, a pair of connector ribs 32, 34 respectively connect the main body 28 to the pressure and suction side walls 16 and 18. As a result, a pair of adjacent radial cavities 43-44, 45-46 are defined on chordally opposite sides of each flow displacement element 26A, 26B. In this example, a first pair of adjacent radial cavities 43-44 are defined on chordally opposite sides of a first flow displacement element 26A. Likewise, a second pair of adjacent radial cavities 45-46 are defined on chordally opposite sides of a second flow displacement element 26B. Each radial cavity 43-46 is formed by respective first and second near wall passages 72, 74 and a respective central channel 76 connecting the respective first and second near wall passages 72, 74. Each of the central channels 76 may be partially sealed by one or more radial ribs 64 as described previously.

As shown, each of the radial cavities 43-46 includes a C-shaped flow cross-section, defined by a pair of respective near wall passages 72, 74 and a respective central channel 76. Further, as shown, a pair of adjacent radial cavities on chordally opposite sides of each flow displacement element 26A, 26B have symmetrically opposed flow-cross-sections. In the shown example, the first pair of adjacent radial cavities 43, 44 each have C-shaped flow cross-sections of symmetrically opposed configurations. That is, the flow cross-section of the radial cavity 44 corresponds to a mirror image of the flow cross-section of the radial cavity 43, with reference to a mirror axis generally perpendicular to the chordal axis 30. The same description holds for the second pair of adjacent radial cavities 45, 46. It should be noted that the term "symmetrically opposed" in this context is not meant to be limited to an exact dimensional symmetry of the flow cross-sections, which often cannot be achieved especially in highly contoured airfoils. Instead, the term "symmetrically opposed", as used herein, refers to symmetrically opposed relative geometries of the elements that form the flow cross-sections (i.e., the near wall passages 72, 74 and the central channel 76 in this example).

The adjacent radial cavities of the pair 43-44 or 45-46, having symmetrically opposed flow cross-sections, may conduct a cooling fluid in opposite radial directions and may be fluidically connected via a respective chordal connector passage to form a serpentine cooling path. In the present example, as shown in FIG. 4, a chordal connector passage between adjacent radial cavities 43-45 may be defined by a gap 50 between the flow displacement element 26A and a radial end face of the airfoil body 12, in this case the airfoil tip 52. Likewise, a chordal connector passage between adjacent radial cavities 45-46 may be defined by a gap between the second flow displacement element 26B and one of the radial end faces 52, 54 of the airfoil body 12. The gap 50 in the interior portion 11 of the hollow airfoil body 12, in cooperation with the symmetrically opposed flow cross-sections of the pair of adjacent radial cavities 43-44 or 45-46, ensures a uniform flow turn at the chordal connector passages from an upstream radial cavity to a downstream radial cavity in the serpentine cooling path. The gap 50 also reduces stresses experienced by the flow displacement element 26A, 26B due to differential thermal expansion with respect to the relatively hot pressure and suction side walls 16 and 18, and further provides convective shelf cooling of the radial end face 52 of the airfoil body 12.

The illustrated embodiments may be used in conjunction with a variety of different cooling schemes. For example, in one embodiment, the first pair of adjacent radial cavities 43-44 may form part of a first serpentine cooling path extending in a forward direction of the airfoil, while the second pair of adjacent radial cavities 45-46 may form part of a second serpentine cooling path extending in an aft direction of the airfoil. In an alternate embodiment, the radial cavities 43-46 may be connected in series by respective chordal connector passages to form a single serpentine cooling path extending either in a forward or in an aft direction of the airfoil. In still further embodiments, the afore-mentioned serpentine cooling schemes may be combined with other cooling schemes, such as impingement cooling, so as to eventually lead the cooling fluid to leading edge and/or trailing edge radial cavities 41 and 48 respectively, from where the cooling fluid may be discharged from the airfoil body 12 via orifices 27 and 29 positioned along the leading and trailing edges 20, 22 of the airfoil body 12 (see FIG. 2). It should however be noted that the particular cooling scheme used is not central to aspects of the present invention.

Figure 6:
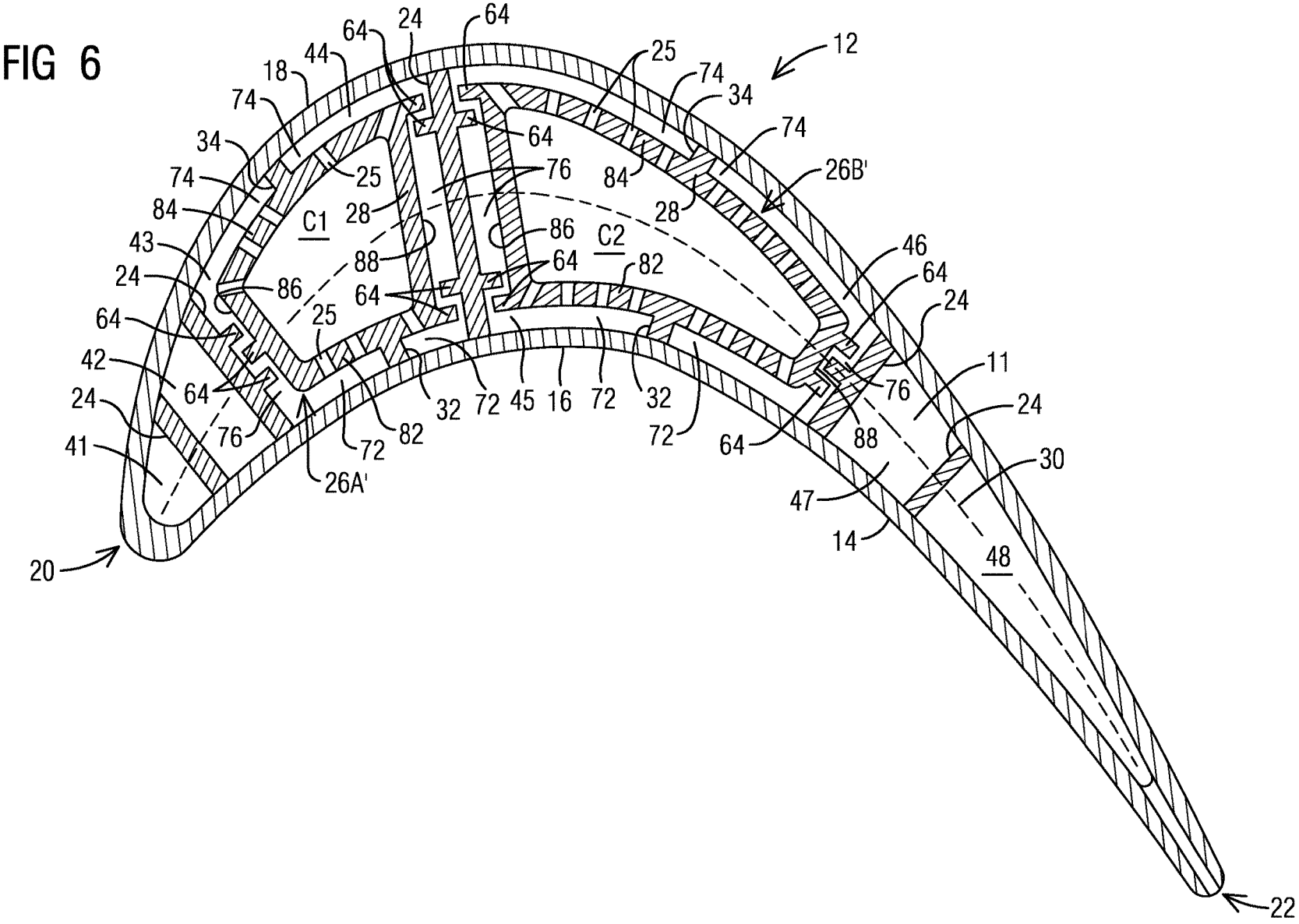
FIG. 6 is a cross-sectional view through a turbine airfoil according to a second embodiment.

Referring to FIG. 6, aspects of the present invention may be applied to an alternate configuration having an internal impingement cooling feature, which may, for example, replace at least a portion of, if not all of, the above-mentioned serpentine cooling scheme. The illustrated configuration may include one or more flow displacement elements 26A', 26B', which are embodied as impingement structures that provide a targeted impingement of the cooling fluid to regions that require most cooling, namely the pressure and suction side walls 16, 18. The structural features of the flow displacement elements 26A', 26B' and the resultant shapes of the radial cavities 43-46 may be largely similar to the flow displacement elements 26A, 26B shown in FIG. 3 and will not be further described. However, in contrast to the embodiment of FIG. 3, the hollow elongated flow displacement elements 26A', 26B' of the present embodiment define respective coolant cavities C1, C2 therewithin that receive a coolant fluid. In this case, the coolant cavities C1, C2 may be open, for example at the root 56, to receive cooling fluid via a cooling fluid supply passage delivering air diverted from a compressor section (not shown). The opposite radial end of the coolant cavities C1, C2 may be located within the interior portion 11 of the airfoil body 12 and may be closed. As shown, a plurality of impingement openings 25 may be formed through each of the main bodies 28 that connect the respective coolant cavity C1, C2 with the first and second near wall passages 72 and 74. The impingement openings 25 direct the cooling fluid flowing in the coolant cavity 64 to impinge on the pressure and suction side walls 16 and 18. In particular, the impingement openings may be formed on the first and second opposite side walls 82, 84 of the main body that respectively face the pressure and suctions side walls 16, 18. The impingement openings 25 may be spaced in the chordal and radial directions to form an impingement array on each of the side walls 82, 84.

In operation, cooling fluid flows radially through the coolant cavity C1, C2, and is discharged through the impingement openings 25 to impinge particularly on the internal surfaces of the hot pressure and suction side walls 16 and 18 to provide impingement cooling to these surfaces. Post impingement, the cooling fluid flows through the adjacent C-shaped radial cavities 43-44 or 45-46 to provide convective cooling of the adjacent hot walls, including not only the pressure and suction side walls 16 and 18 but also the partition wall 24. In particular, the main body 28 displaces the cooling fluid from the center of the airfoil toward the near wall passages 72 and 74 of the radial cavities 43-44 and 45-46. One or more radial ribs 64 may be positioned in the central channels 76 to partially seal the central channels in a manner described previously. The inclusion of the radial ribs prevents migration of the cooling fluid to and from the first and second near wall passages 72, 74 via the central channel 76, which may occur, for example, in a turbine blade under rotation. Additionally, each central channel 76 may be covered at one or both radial ends of the ribs 64 by a respective flow blocking element 66 in a manner described previously, to prevent the cooling fluid from entering the respective central channel 76 from the radially inner and/or outer ends.

The C-shaped radial cavities 43-44 or 45-46 may be fluidically connected via a respective chordal connector passage defined by the gap between the respective coolant cavity C1, C2 and the airfoil tip 52. The airfoil tip 52 may be provided with exhaust orifices via which the coolant fluid may be discharged from the airfoil 10, providing film cooling on the external surface of the airfoil tip 52 exposed to the hot gases. The afore-mentioned impingement cooling feature may be combined with other serpentine and/or impingement and/or any other cooling schemes, so as to eventually lead the cooling fluid to leading edge and trailing edge radial cavities 41 and 48 respectively, from where the cooling fluid may be discharged from the airfoil body 12 via orifices 27 and 29 positioned along the leading and trailing edges 20, 22 of the airfoil body 12 (see FIG. 2). Again, the particular cooling scheme used is not central to aspects of the present invention.

In a preferred embodiment, the flow displacement elements 26A-B or 26A'B' and the radial ribs 64 may be manufactured integrally with the airfoil body 12 using any manufacturing technique that does not require post manufacturing assembly as in the case of inserts. In one example, the flow displacement element 26 may be cast integrally with the airfoil body 12, for example from a ceramic casting core. Other manufacturing techniques may include, for example, additive manufacturing processes such as 3-D printing. This allows the inventive design to be used for highly contoured airfoils, including 3-D contoured blades and vanes.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine airfoil comprising:

a generally hollow airfoil body formed by an outer wall extending span-wise along a radial direction, the outer wall comprising a pressure side wall and a suction side wall jointed at a leading edge and a trailing edge, wherein a chordal axis is defined extending generally centrally between the pressure side wall and the suction side wall, a plurality of radially extending partition walls positioned in an interior portion of the airfoil body and connecting the pressure and suction side walls, the partition walls being spaced along the chordal axis, and a flow displacement element positioned in a space between a pair of adjacent partition walls and comprising a radially extending elongated main body which is spaced from the pressure and suction side walls and spaced from one or both of the adjacent partition walls, whereby a first near wall passage is defined between the main body and the pressure side wall, a second near wall passage is defined between the main body and the suction side wall and a central channel is defined between the main body and a respective one of the adjacent partition walls, the central channel being connected to the first and second near wall passages along a radial extent, wherein one or more radial ribs are positioned in the central channel that extend partially across the central channel between the main body of the respective adjacent partition wall, wherein the flow displacement element further comprises first and second connector ribs that respectively connect the main body to the pressure side wall and the suction side wall, wherein a pair of adjacent radial cavities are defined on chordally opposite sides of the flow displacement element, wherein each of the radial cavities is formed by respective first and second near wall passages and a respective central channel connecting the respective first and second near wall passages and having at least one of said one or more radial ribs positioned therein.

2. The turbine airfoil according to claim 1, wherein at least one of the one or more radial ribs is connected to the main body along a radial extent and spaced from the respective adjacent partition wall.

3. The turbine airfoil according to claim 1, wherein at least one of the one or more radial ribs is connected to the respective adjacent partition wall along a radial extent and spaced from the main body.

4. The turbine airfoil according to claim 1, wherein the one or more radial ribs include a plurality of radial ribs spaced in a lengthwise direction of the central channel, wherein consecutive radial ribs are alternatingly connected either to the main body or the respective adjacent partition wall, and wherein the consecutive radial ribs overlap partially along a widthwise direction of the central channel.

5. The turbine airfoil according to claim 1, wherein the one or more radial ribs extend substantially along an entire radial extent of the central channel.

6. The turbine airfoil according to claim 1, wherein a flow blocking element is positioned to cover the central channel at a radial end of the one or more radial ribs.

7. The turbine airfoil according to claim 6, wherein the flow blocking element comprises multiple overlapping parts that in combination extend across a flow cross-section of the central channel at the radial end.

8. The turbine airfoil according to claim 7, wherein the flow blocking element is contoured in a direction along a length of the central channel transverse to the chordal axis, to guide a cooling fluid flow toward the near wall passages.

9. The turbine airfoil according to claim 1, wherein the adjacent radial cavities of said pair are fluidically connected by a chordal connector passage defined by a gap between the flow displacement element and a radial end face of the airfoil body.

10. The turbine airfoil according to claim 9, wherein the pair of adjacent radial cavities conduct a cooling fluid in opposite radial directions to form a serpentine cooling path.

11. The turbine airfoil according to claim 1, wherein the main body is hollow, defining an elongated radial cavity therewithin, the elongated radial cavity being a coolant cavity that receives a cooling fluid, and wherein a plurality of impingement openings are formed through the main body that connect the coolant cavity with the first and second near wall passages, for directing the cooling fluid flowing in the coolant cavity to impinge on the pressure and/or suction side walls.

12. A turbine airfoil comprising:

a generally hollow airfoil body formed by an outer wall extending span-wise along a radial direction, the outer wall comprising a pressure side wall and a suction side wall jointed at a leading edge and a trailing edge, wherein a chordal axis is defined extending generally centrally between the pressure side wall and the suction side wall, a plurality of radially extending partition walls positioned in an interior portion of the airfoil body and connecting the pressure and suction side walls, the partition walls being spaced along the chordal axis, and a flow displacement element positioned in a space between a pair of adjacent partition walls and comprising a radially extending elongated main body which is spaced from the pressure and suction side walls and spaced from one or both of the adjacent partition walls, whereby a first near wall passage is defined between the main body and the pressure side wall, a second near wall passage is defined between the main body and the suction side wall and a central channel is defined between the main body and a respective one of the adjacent partition walls, the central channel being connected to the first and second near wall passages along a radial extent, wherein on or more radial ribs are positioned in the central channel that extend partially across the central channel between the main body of the respective adjacent partition wall, wherein the main body is hollow, defining an elongated radial cavity therewithin, the elongated radial cavity being an inactive cavity.

13. A turbine airfoil comprising:

a generally hollow airfoil body formed by an outer wall extending span-wise along a radial direction, the outer wall comprising a pressure side wall and a suction side wall jointed at a leading edge and a trailing edge, wherein a chordal axis is defined extending generally centrally between the pressure side wall and the suction side wall, a plurality of radially extending partition walls positioned in an interior portion of the airfoil body and connecting the pressure and suction side walls, the partition walls being spaced along the chordal axis, and a flow displacement element positioned in a space between a pair of adjacent partition walls and comprising a radially extending elongated main body which is spaced from the pressure and suction side walls and spaced from one or both of the adjacent partition walls, whereby a first near wall passage is defined between the main body and the pressure side wall, a second near wall passage is defined between the main body and the suction side wall and a central channel is defined between the main body and a respective one of the adjacent partition walls, the central channel being connected to the first and second near wall passages along a radial extent, wherein on or more radial ribs are positioned in the central channel that extend partially across the central channel between the main body of the respective adjacent partition wall, wherein the main body comprises:

first and second opposite side walls that respectively face the pressure and suction side walls, and forward and aft end walls that extend between the first and second side walls, wherein the one or more radial ribs extend partially across the central channel between the forward and/or aft end walls of the main body and the respective adjacent partition wall.

14. The turbine airfoil according to claim 13, wherein the first and second side walls are generally parallel to the pressure side wall and the suction side wall respectively.

* * * * *